US006366301B1

(12) United States Patent
Thomas et al.

(10) Patent No.: US 6,366,301 B1
(45) Date of Patent: Apr. 2, 2002

(54) MAN-MACHINE INTERFACE FOR A VIRTUAL LOCKOUT/TAGOUT PANEL DISPLAY

(75) Inventors: Robert P. Thomas, Ellington; John S. Vandevanter, East Granby; Geoff Butland, Farmington, all of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/376,601

(22) Filed: Aug. 18, 1999

Related U.S. Application Data

(63) Continuation of application No. 09/154,875, filed on Sep. 17, 1998.

(51) Int. Cl.[7] ..... G09G 5/00

(52) U.S. Cl. ..... 345/771; 345/810; 702/183; 702/184

(58) Field of Search ..... 702/182, 183, 702/184, 185, 186; 345/771, 772, 810, 835, 838, 840

(56) References Cited

U.S. PATENT DOCUMENTS

| | | | | |
|---|---|---|---|---|
| 4,672,501 A | | 6/1987 | Bilac et al. | 361/42 |
| 4,777,607 A | | 10/1988 | Maury et al. | 307/86 |
| 4,916,628 A | | 4/1990 | Kugler | 307/11 |
| 5,502,286 A | | 3/1996 | Pollman et al. | 200/308 |
| 5,675,756 A | | 10/1997 | Benton et al. | 345/839 |
| 5,970,437 A | * | 10/1999 | Gorman et al. | 702/184 |

FOREIGN PATENT DOCUMENTS

| | | |
|---|---|---|
| DE | 24 09 995 A1 | 9/1975 |
| EP | 0 584 895 A2 | 3/1994 |
| EP | 0 800 248 A1 | 8/1997 |
| EP | 0 824 263 A2 | 2/1998 |

* cited by examiner

*Primary Examiner*—Ba Huynh
(74) *Attorney, Agent, or Firm*—Cantor Colburn LLP; Carl B. Horton

(57) ABSTRACT

A three dimensional power management control system provides control and graphical representation of a plurality of electrical devices and components of an electrical distribution system. The PMCS includes a graphical representation of tagout/lockout displays (i.e., Danger and Ground Tags) representative of a physical lockout/tagout tag attached locally to a device of the electrical distribution system. The graphical displays include a large bit map representative of a Danger tag and a Ground Tag installed on a device, and representative symbols displayed at other graphical and tabular data displays associated with the tagged device. The implementation of the virtual lockout/tagout displays is automated using software, namely a Tagging Wizard. The Tagging Wizard provides automated configuration of the lockout/tagout graphic and the ability to install and remove virtual tagout displays associated with the graphical representation of the device of the distribution system. The Tagging Wizard logically links a one-line wizard associated with each graphical and/or tabular representation a common device to a common discrete memory tag for storing the tagged condition of a device. A "Tag Menu" window includes an install and remove button for each lockout/tagout tag that when selected stores data in the memory tag.

15 Claims, 11 Drawing Sheets

MAN-MACHINE INTERFACE FOR A VIRTUAL LOCKOUT/TAGOUT PANEL DISPLAY

This is a continuation of application Ser. No. 09/154,875, filed Sep. 17, 1998 pending.

BACKGROUND OF THE INVENTION

The present invention relates generally to a power management control system and in particular, to software that automates the implementation of a virtual 3D lockout/tagout display with database links which allow installing and tracking of virtual Danger and Ground Tags and tag symbols on graphical one-line diagrams, 3D Faceplate Power Wizard graphics, and Tabular Data Power Wizard Graphics.

Power management control systems monitor and control a variety of electronic monitoring or control devices of an electrical distribution system. The power management control system includes a computer connected to a common bus that allows the intelligent monitoring or control devices to communicate with a server. The control system provides graphical representations of and links to the devices of the distribution system to enable a user to monitor and operate the distribution system.

During the maintenance and repair of the electrical distribution system a technician may be required to periodically maintain or troubleshoot the electrical distribution system which may require the technician to shut down a portion of the electrical distribution system or ground a lead of a device. In doing so, the technician attaches an associated Danger Tag and/or Ground Tag on a device to caution others not to actuate or energize the tagged device which may result in damage to the equipment, or worse, injury to a technician servicing the electrical distribution system.

This step of tagging or locking out the device requires the technician to prepare the appropriate Danger and/or Ground Tag by writing his name and the date when the tag was installed on the relevant device. The technician may also temporally install a lock onto the device to prevent accidental actuation of the device, e.g. a circuit breaker unit. Once the device has been "tagged out" locally, the technician may choose to notify the operator of the PMCS of the tagout condition.

Currently the operator must note or remember the tagout condition of a device. Unlike the physical tag located locally at the tagged device, the operator has no graphical identification on the PMCS to remind or indicate to a new operator of the tagout condition of a device.

BRIEF SUMMARY OF THE INVENTION

This invention offers advantages and alternatives over the prior art by providing a Tagging Wizard for a power management control system that automates the implementation of a virtual lockout/tagout display that allows installing and tracking of virtual Danger and Ground Tags and tag symbols with graphical representations of selected electronic devices. The invention allows the user to generate a lockout/tagout graphic interface quickly without programming skills, eliminating custom programming by the integrator.

In accordance with a present invention, a method of generating a lockout tag display indicative of the tagging status of a selected device of a power management control system ("PMCS") comprises selecting a device of the power management control system from a window of the PMCS. A Tagging Wizard is selected that is associated with the selected device. A lockout tag is then installed graphically with a graphical representation of the selected device.

BRIEF DESCRIPTION OF THE DRAWINGS

Referring now to the drawings wherein like elements are numbered alike in the several FIGURES.

DETAILED DESCRIPTION OF THE INVENTION

Figure 1:
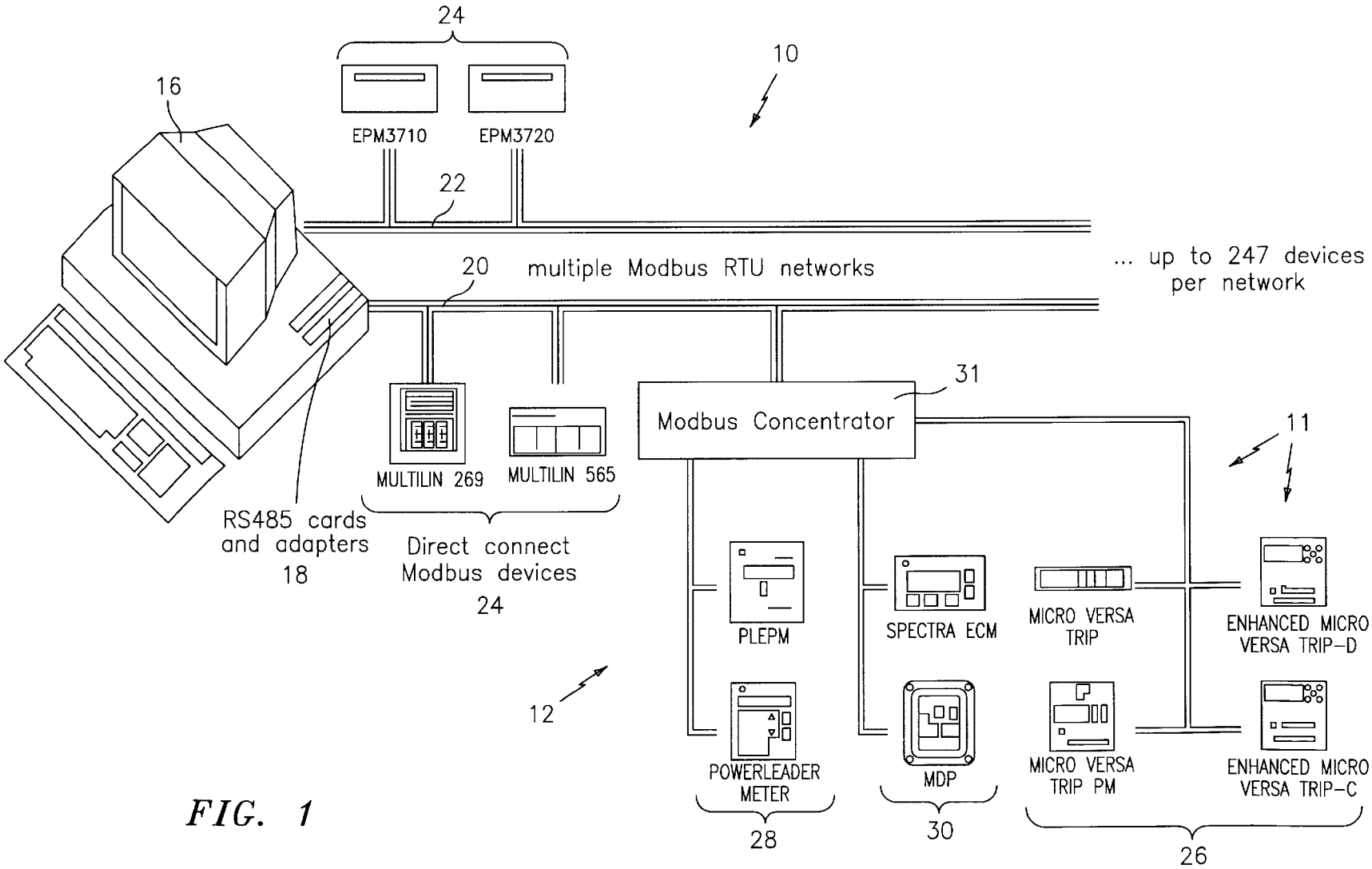
FIG. 1 is a diagrammatic block diagram of a power management and control system in accordance with the present invention.

Referring now to FIG. 1, a power management control system ("PMCS"), generally designated 10, provides control and a three-dimensional graphical representation of a plurality of electrical devices and components 11 of an electrical distribution system 12, such as control devices, trip units, power meters and relays, as will be described in greater detail hereinafter.

The PMCS 12 of FIG. 1 comprises a computer 16, e.g., an IBM-PC AT compatible machine which is based on a Pentium processor, having standard RS485 interface cards 18, or an RS232 to RS485 convertor, and adapters installed in its I/O slots. The computer 16 contains software for monitoring and controlling selected aspects of power usage/consumption, as described in more detail hereinafter. Interface cards 18 provide I/O ports, which define multiple industry standard Modbus RTU networks 20 and 22. The Modbus RTU protocol is a well-known industry standard. Devices with a Modbus RTU interface can be connected directly to the Modbus, e.g., control devices 24, such as, Multilin models 269 and 565 and power management EPM 3710 and EPM 3720. Other devices communicate on the Commnet protocol and include trip units 26, e.g., Trip, Enhanced Trip-D, Trip PM and Enhanced Trip-C Units, which are commercially available from General Electric Co., meters 28, e.g., Power Leader Meters commercially available from General Electric Co., and relays 30, e.g., General Electric Co.'s Spectra ECM and Power Leader MDP. A Modbus concentrator 31 provides an interface between the Modbus RTU protocol and the Commnet protocol, whereby these devices can communicate through Modbus concentrator 31 over the Modbus. In this example, up to thirty-two devices (i.e., direct connect devices or Modbus concentrators) can be connected to each Modbus RTU network.

As described hereinbefore, a technician may be required to periodically maintain or troubleshoot the electrical distribution system 12 which may require the technician to shut down a portion of the distribution system or ground a lead of a device 11. In doing so, the technician attaches an associate Danger Tag and/or Ground Tag onto the device to caution others not to actuate or energize the tagged device. In accordance with the present invention, the technician or operator, having sufficient access level, may also tag the graphical representations of the devices 11 on the PMCS 10 to provide an indicator to the operator overseeing the electrical distribution system 12 of the tagout condition of the device.

Figure 2:
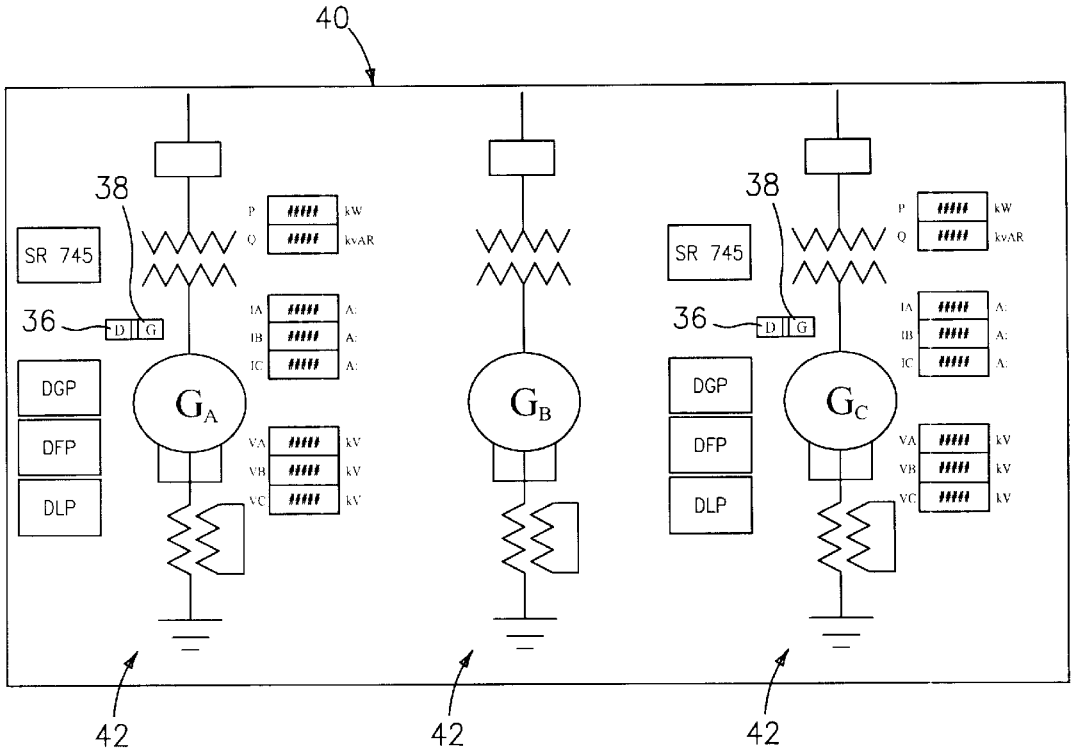
FIG. 2 is a view of a display window of a portion of an electrical distribution system including tag symbols indicative of lockout/tagout tag associated with a component of the electrical distribution system generated by computer software embodying the present invention.
Figure 3:
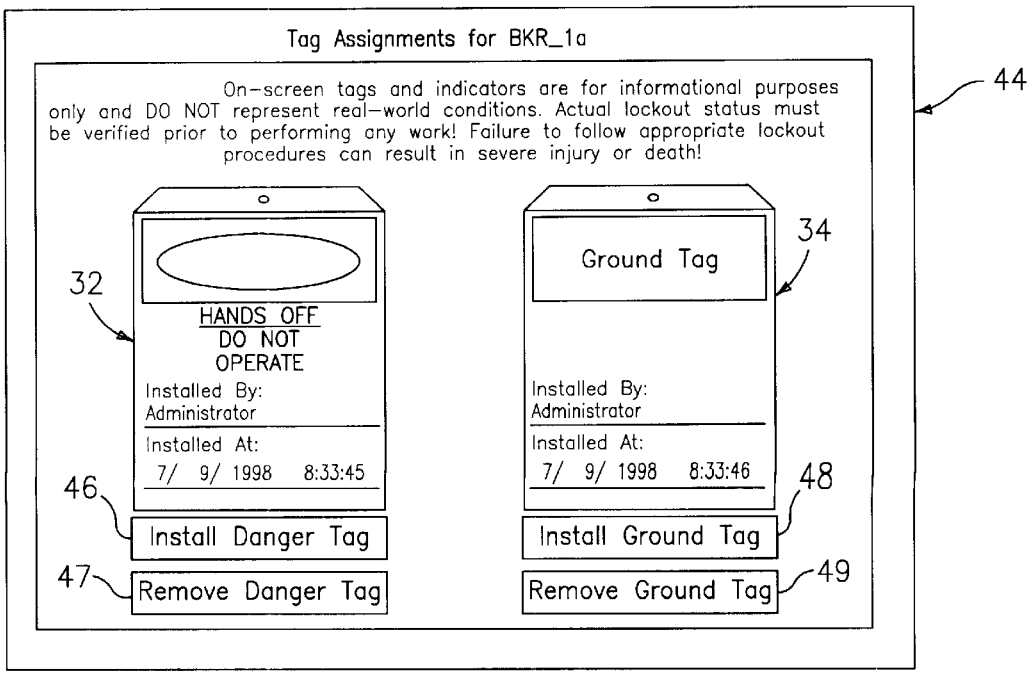
FIG. 3 is a view of a virtual lockout/tagout panel display window generated by computer software embodying the present invention showing the installation of a virtual Danger Tag and Ground Tag.

The implementation of a virtual lockout/tagout displays 32, 34 (i.e., virtual Danger and Ground Tags) as shown in FIG. 3, are automated using software, namely a Tagging Wizard. The Tagging Wizard provides the automated configuration of the lockout/tagout graphic and the ability to install and remove virtual tagout displays on graphical representation of the devices 11 of the electrical distribution system 12, as shown in FIG. 2. The Tagging Wizard provides a rapid and cost effective method by which to provide virtual Danger and Ground Tag displays 32, 34 and tag symbols 36, 38 (see FIG. 2) without any programming skills or detailed device knowledge.

Referring to FIG. 2, a window 40 illustrates a graphical representation of one-line diagrams 42 of a plurality of generator circuits of the electrical distribution system 12. The diagrams 42 include generators $G_A$, $G_B$, and $G_C$, wherein generators $G_A$ and $G_C$ each include a pair of tag symbols 36, 38 representative of the presence of a virtual Danger Tag 32 and a Ground Tag 34 (see FIG. 3) attached to generators $G_A$ and $G_C$. The Danger Tag symbol 36 comprises the letter "D" disposed within one box, and the Ground Tag symbol 38 includes the letter "G" disposed within another box. As shown in FIG. 2, the presence of both a Danger and Ground Tag symbol 36, 38, respectively, adjacent both the generators $G_A$ and $G_C$ indicate the presence of a virtual Danger and Ground Tag attached thereto, while generator $G_B$ does not include either tag symbol. These tag symbols 36, 38 provide a virtual tag or indicator to the operator indicative of the condition or status of selected components 11 of the electrical distribution system 12, warning the operator from actuating any components that may energize the tagged devices. The tag symbols 36, 38 for a particular device are not only displayed in the one line diagram representation 42, but also any other graphical representation or interface of the device 11 such as the virtual display of the large faceplate of the device, as will be described in greater detail hereinafter.

As shown in FIG. 3, each tag symbol 36, 38 is associated to a corresponding graphical representation of the virtual Danger Tag 32 or Ground Tag 34 displayed in the virtual lockout/tagout panel display window or "Tag Menu" window 44. Each virtual Tag 32, 34 is represented by a large corresponding bit map that any user may view by either selecting "Tag Menu" from a pull down menu or by pointing and clicking on one of the two tag symbols 36, 38 (see FIG. 2). Both of the virtual Tags 32, 34 provide information concerning the individual that installed the Tag and the date and time the Tag was installed. For example, the virtual Danger Tag 32 was installed at Jul. 9, 1998 at approximately 8:30 a.m. by the Administrator and the virtual Ground Tag 34 was also installed by the Administrator at Jul. 9, 1998 at approximately 8:30 a.m. The virtual Danger Tag 32 further includes a warning to keep "hands off" and "do not operate" the tagged device 13. The "Tag Menu" window 44 also includes a warning that the on-screen Tags and indicators are for informational purposes and the lockout status of tagged device must be verified before performing any work.

Only a privileged user may install and/or clear a virtual lockout Tag 32, 34. Each user of the PMCS 10 is assigned an access level. A privileged user is one having an access level greater than or equal to the access level assigned to the lockout/tagout application. The PMCS further includes a real time clock for providing the current date and time when a virtual lockout tag 32, 34 is installed.

Figure 4:
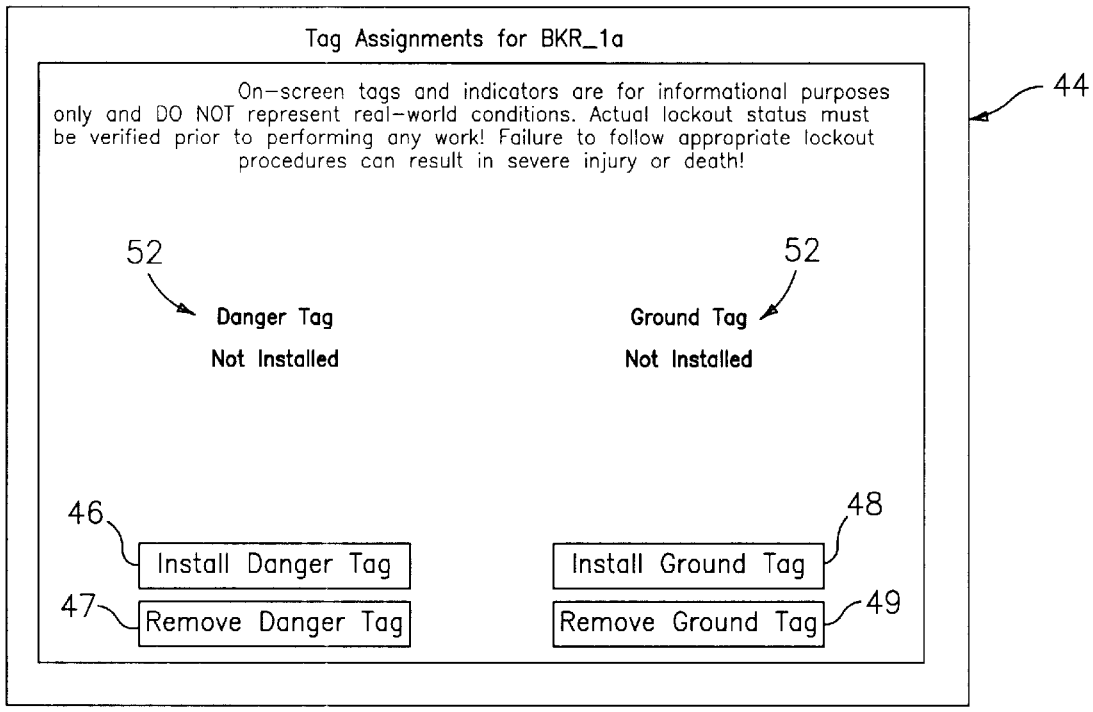
FIG. 4 is a view of a virtual lockout/tagout panel display window generated by computer software embodying the present invention showing the absence of the virtual Danger Tag and Ground Tag.

Each virtual tag 32, 34, shown in the "Tag Menu" window 44 of FIG. 3, also includes a pair of buttons 46–49 for a privileged user to install and/or remove a respective Tag from the selected device 11. To install or remove a virtual Danger Tag 32 for a device 11, the privileged user selects a corresponding "Tag Menu" from a pull down menu for a corresponding device, or selects the tag symbol 36 (see FIG. 2) displayed adjacent a graphical representation of the tagged device (i.e., generator $G_A$). The user then selects the corresponding button 46, 47 to install or remove the Danger Tag 32. For example, if the user wishes to remove or clear the Ground Tag 34, the user selects the "Remove Ground Tag" button 49 by pointing and clicking. If the access level of the user is at least the required access level to install or clear the Tag, the virtual Ground Tag 34 is deleted from the "Tag Menu" window 44 and the phrase "Ground Tag Not Installed" 52 replaces the bit map representation of the Ground Tag as shown in FIG. 4. If not, the user with insufficient access level will receive a message stating that they are not authorized to perform the requested function and the user's request is not processed.

If the user wishes to install a virtual Danger Tag 32, the user selects the "Install Danger Tag" button 46 by pointing and clicking. If the access level of the user is sufficient, the bit-map of the virtual Danger Tag 32 is displayed in the "Tap Menu" window 44. The current time and date, and the installer's identity are entered automatically by the PMCS 10. Once the virtual lockout tag is installed, the associated one line tag symbols 36, 38 appear on the graphical displays of a device (i.e., faceplate displays, tabular data and one-line diagrams), as shown in FIG. 2, until a privileged user removes them.

FIG. 4 illustrates the "Tag Menu" window 44 for the generator $G_B$ of FIG. 2 having no virtual tags 32, 34 associated therewith. As described hereinbefore, a phrase or indicator is displayed in place of the bit map of both virtual tags that the respective tag is not installed.

Figure 5:
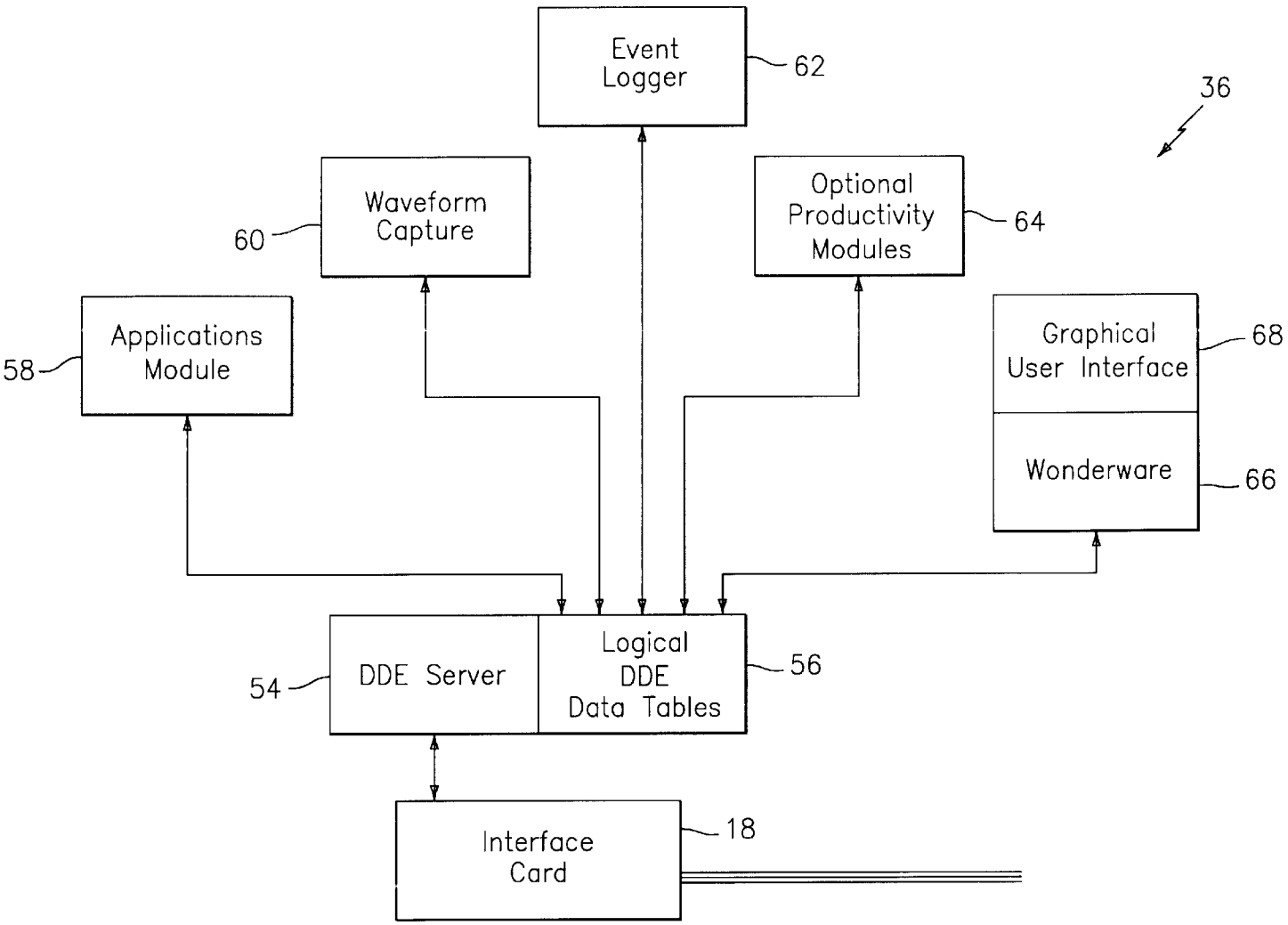
FIG. 5 is a block diagram of the computer software used in the power management and control system of the present invention.

Referring now to FIG. 5, a block diagram of the software for monitoring and controlling selected aspects of power usage/consumption of the PMCS 10, discussed above, is generally shown. This software is loaded into the computer 16 and includes a dynamic data exchange (DDE) server 54. DDE server 54 allows external programs to access power management data in a Microsoft Windows environment. Data interface to DDE server 54 is provided by the system through a Wonderware InTouch utility. The DDE server is a 32 bit application under Windows NT. A configuration and control interface for the DDE server is provided through server application window menus. Associated with DDE server 54 are logical data tables 56 and related modules, i.e., an Excel or other DDE aware applications module 58, a waveform capture module 60, an event logger module 62, productivity modules 64, and a Wonderware InTouch module 66. Wonderware InTouch module 66 includes a tool kit for building screens and interfaces, and a graphical user interface 68 for monitoring and control of the electrical distribution system 12. The graphical user interface 68 for the server operates in 32 bit Windows or Windows NT environment and InTouch library functions. Waveform capture module 60 provides for viewing and analysis of waveforms (e.g., Fourier, frequency and/or harmonic analysis) captured by sophisticated metering devices. Event Logger module 62 provides for viewing, organizing and analyzing unusual behavior in a distribution system 12. Productivity modules 64 include, for example, a cost allocation module and a load management module. The cost allocation module provides for tracking power consumption to the sub-unit level, developing internal billing methods and reports, and thereby reducing cost. The load management module provides for tracking power demand and automatically shedding non-critical loads to prevent peak demand penalties, and provides for timer-based control to reduce power consumption. DDE server 54 communicates though the interface card 18 shown in FIGS. 1 and 5.

The event logger module 62 includes a utility that passes a received message as an unacknowledgeable or acknowledgeable alarm or as an event based upon the contents of an initialization file. The DDE server 54 ensures that all events are cast in the same format so that the event logger module 62 can interpret each event. Electrical meters 28 and control/protection devices 26 use various codes to describe occurrences to the circuits that are monitored or controlled. A file collates these codes into three categories for analysis. These three categories for any particular device are modifiable for the code received from a device. The three categories are 'ACK/UNACK' for acknowledgeable alarms, '-' for alarms requiring no acknowledgment, and "EVENTS" for merely reporting the device status.

The waveform capture module 60 includes a utility that provides an interface to configure and display data from a device that transmits waveform data. These devices transmit waveform data with different formats. One uniform display format is desired for these different types of meters. This utility applies header information transmitted by the meter to correctly scale and display the comma separated value data transmitted by the devices as applicable.

Figure 6:
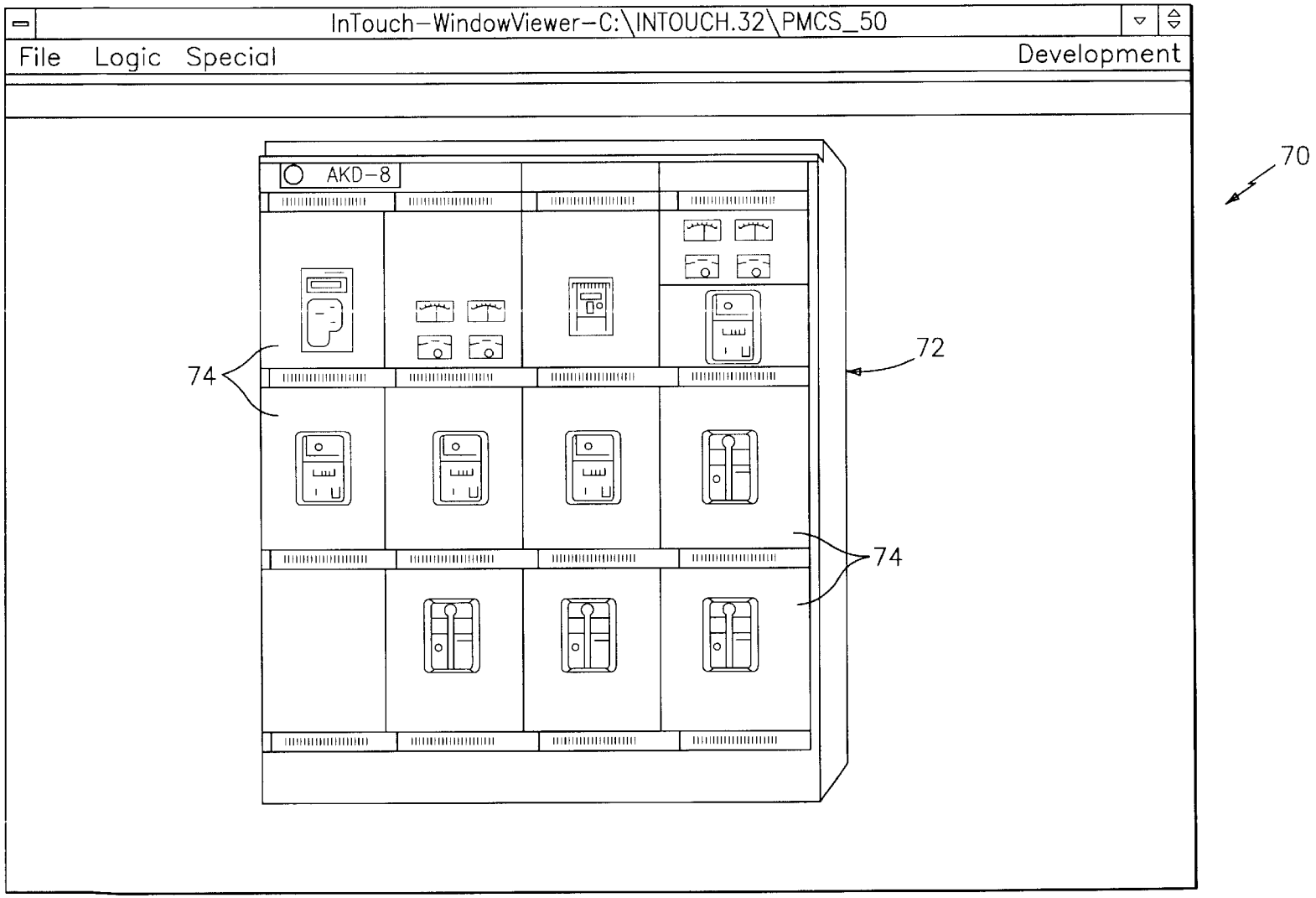
FIG. 6 is view of an InTouch—windowviewer window generated by the computer software of FIG. 5.
Figure 7:
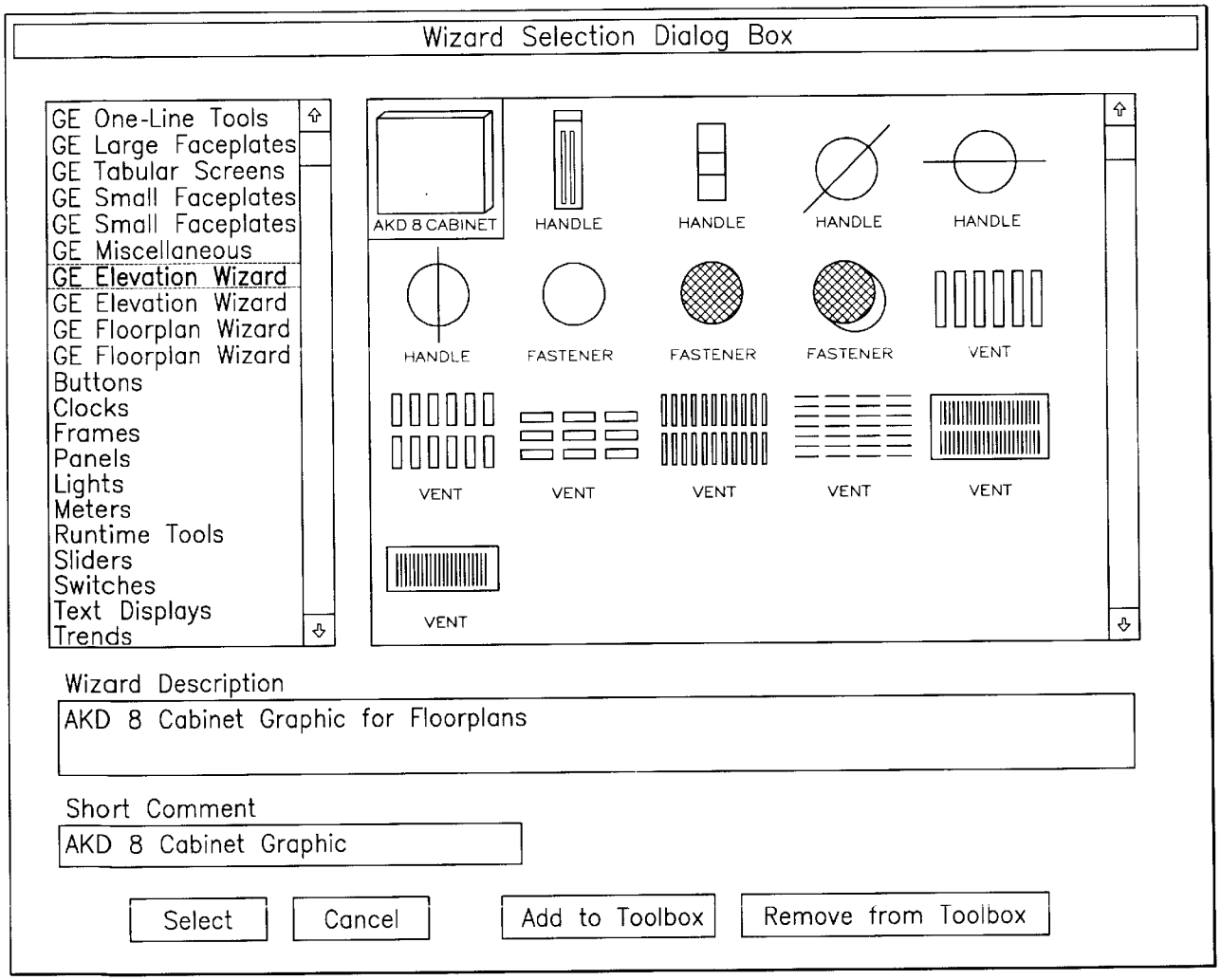
FIGS. 7–10 are views of wizard selection dialog box windows generated by the computer software of FIG. 5.
Figure 8:
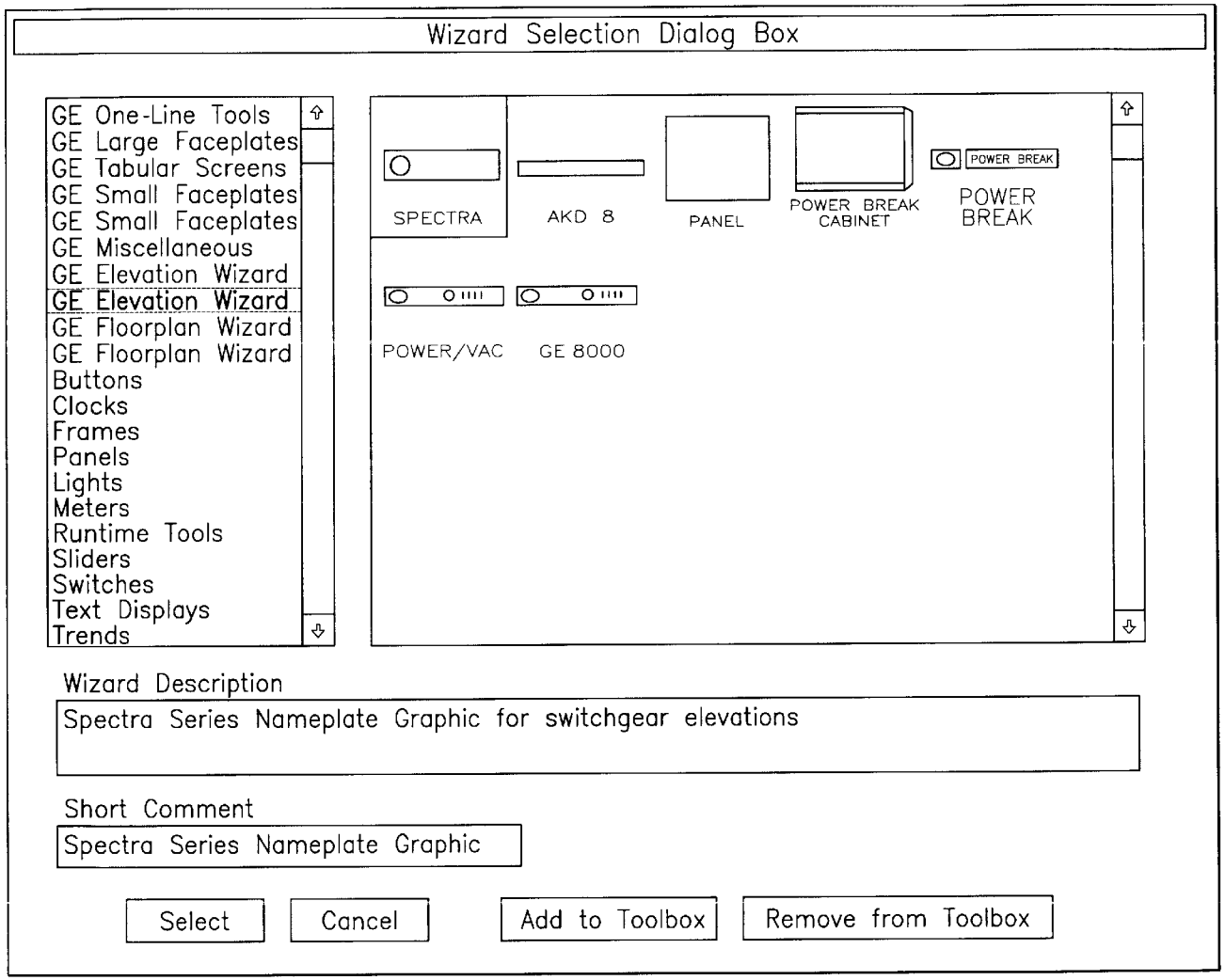
Figure 9:
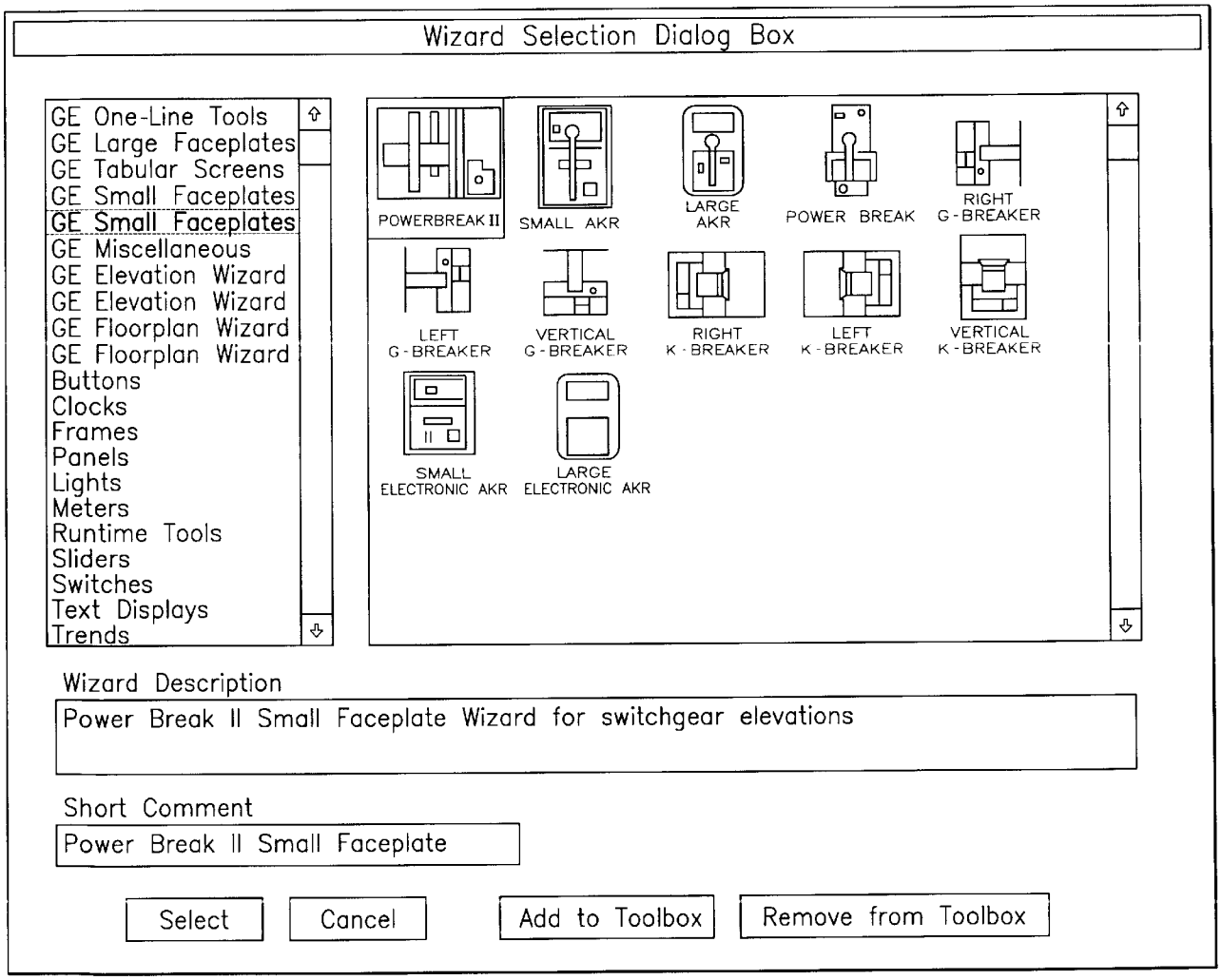
Figure 10:
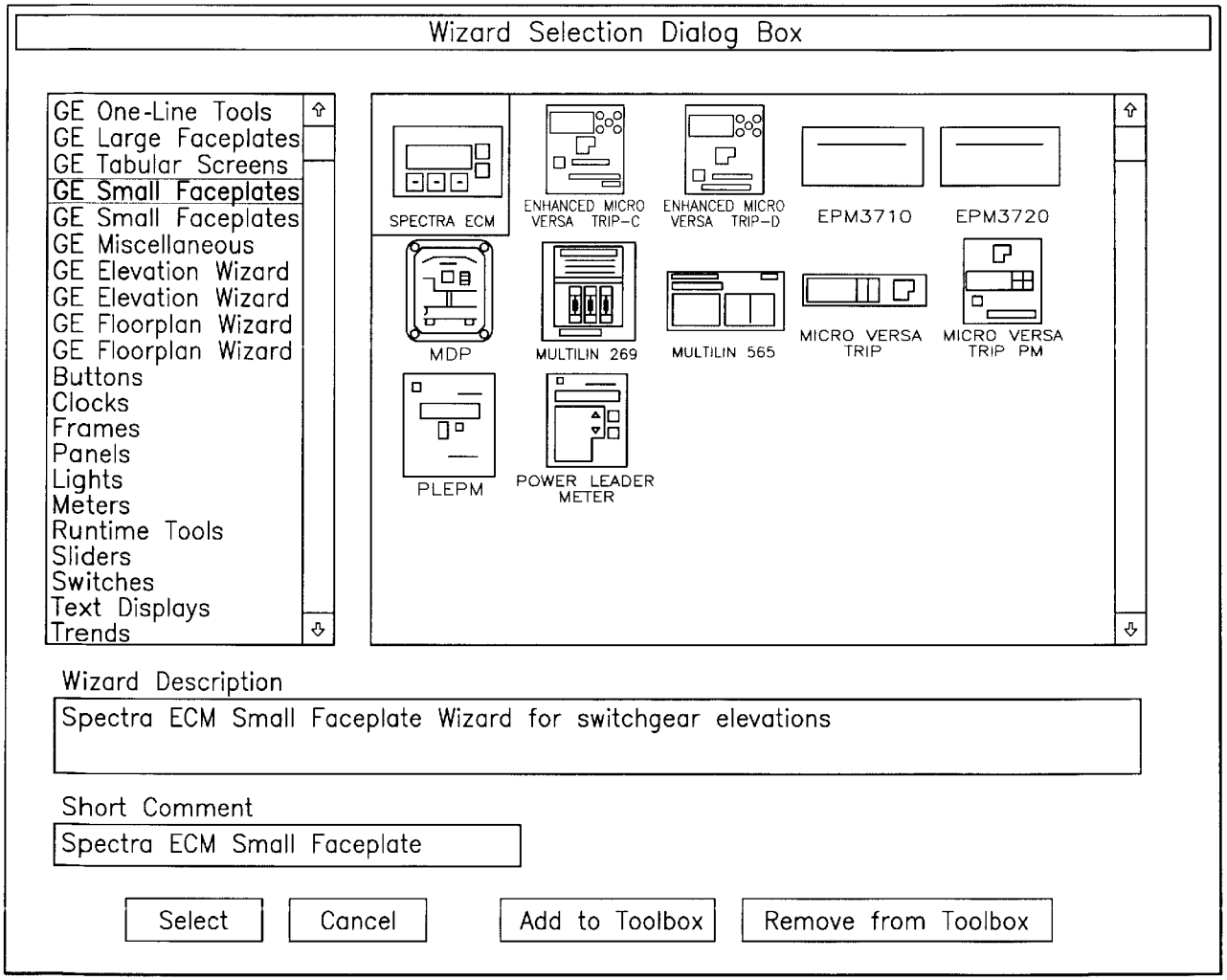

As shown in the InTouch window 70 of FIG. 6, the Wonderware InTouch module 66 includes a software toolkit for rapid development of three-dimensional representations of electrical distribution switchgear 72. These switchgear elevations have logical connections to the switchgear devices 74. A typical switchgear elevation developed with the so-called Power Wizards illustrated in FIGS. 7–10 is shown. This elevation 72 can be modified to any dimensions with an infinite number of combinations and arrangements of meters and protection devices to quickly and accurately represent a customer's switchgear. The Power Wizards eliminate the necessity to draw each individual component 72 line by line. The user starts by selecting a cabinet wizard such as the AKD-8 or Power Break Cabinet to which handles, panels, and fasteners are added, as shown in FIGS. 7 and 8. Thereafter, circuit breakers (FIG. 9), meters and other protection devices (FIG. 10) are located or dropped onto the appropriate panels in the same locations as the customer's actual switchgear 74. These items have dialog boxes associated with them that are opened by double clicking on one of the Power Wizards once they have been dropped. From this dialog box a navigational link is established to another window that contains another Power Wizard that displays detailed metering, configuration, and control information as shown in FIG. 11.

The Wonderware InTouch module 66 includes predefined tabular representations of metering and setup/set point information that is generated automatically, with the appropriate database server links established. A rapid method is provided to accurately generate a user interface for power distribution metering, protection, and control devices with the capability to repeat this interface repeatedly for many devices of the same type while maintaining the capability to uniquely identify a device. The Power Wizards allow the user to generate a power distribution device interface without programming skills or detailed knowledge of the device.

Figure 11:
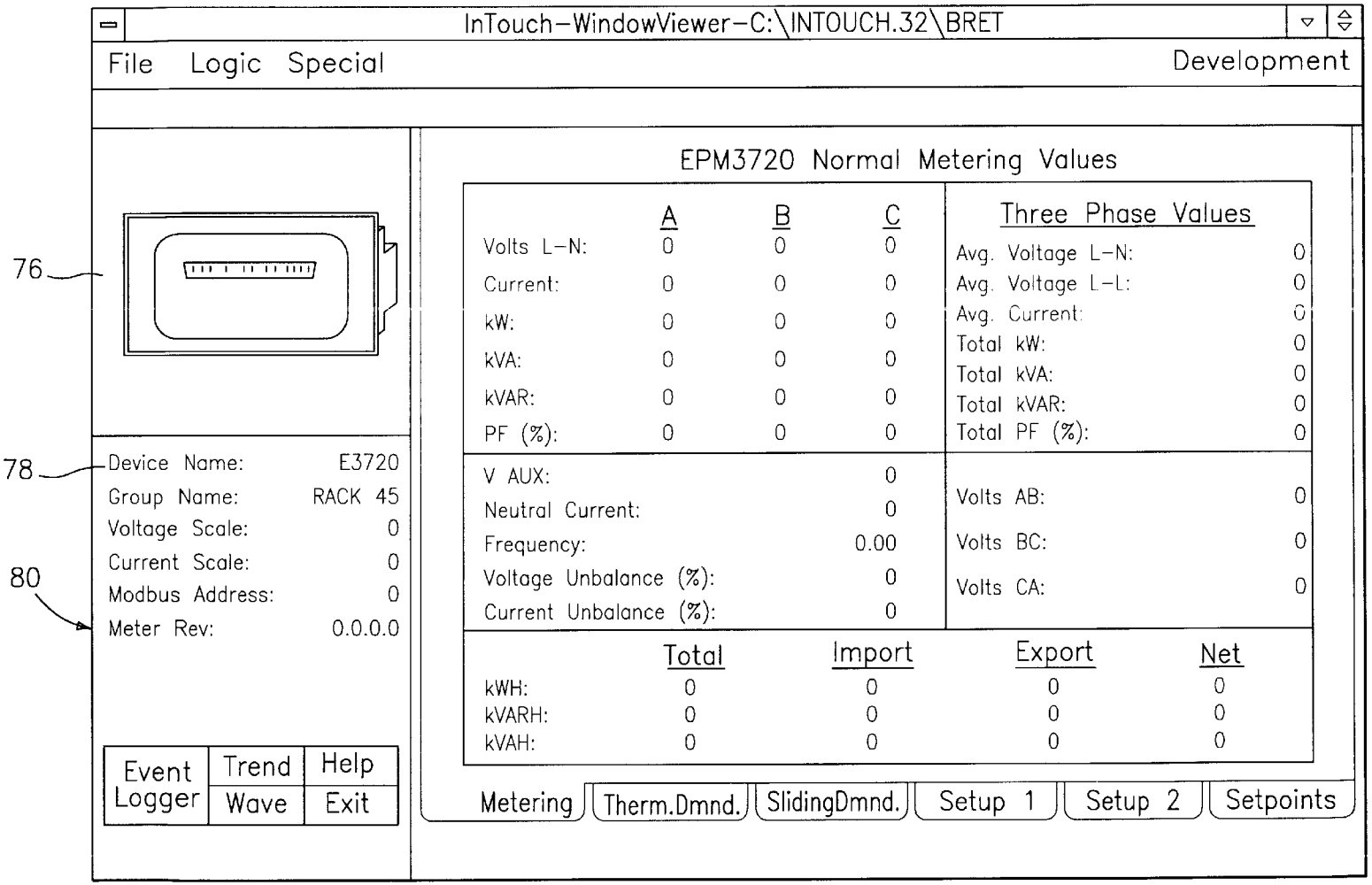
FIG. 11 is a view of an InTouch—windowviewer window generated by the computer software of FIG. 5.

Referring to FIG. 11, an example of a Power Wizard of a metering device 76 is shown. The Power Wizards instantly develop a standard looking interface for a particular device type. These Power Wizards also create from this standard interface, unique database links that the user defines by selecting a name 78 and entering in this name from a Power Wizard dialog box 80. In this way the same wizard may be used over and over again but can be logically distinguished from another via the user-defined name for a device entered in the Power Wizard dialog box. All margins for error that may have occurred in manually entering in the data access links to a database server are removed by the Power Wizards capability to set them up automatically using a unique user defined device name.

Every windows application is registered in a windows kernel with an application name. To uniquely identify a data item for communication between two cooperating (DDE aware) windows applications, the data item is identified by tuple (Application, Topic, Item). Topic name provides a grouping, and item name specifies the actual data point to be accessed under a topic. For the DDE server 54, the application name is the server's executable name. Topic name can be the device identification name and item name can be the register identification of a field data point. For example, with a General Electric Co. EPM meter, the tuple can be GE32MODB, EPM1, AMP_A where GE32MODB is the Application name for a DDE Server, EPM1 is the meter identification name, and AMP_A is the current for phase A. DDE messages mainly include requests to send data as identified by the Topic and Item name. They may also be for set point download to the data point as identified by the Topic and Item names. Input parameter values are reported by field devices on the communication interface in response to a poll by the server. This value may be a float value, an integer value, a string or discrete status bits.

Set points registers are downloaded based on request from a DDE client, i.e., a program, for example, such as Wonderware InTouch 5.0 or MS-Excel, which request data items from the DDE server 54 and accepts data through DDE. The DDE server acts as a link between a client requesting device data and a field device, which can provide the data. The DDE server communicates to the field device through communication ports and to the client via DDE message link. A client sends its requests to the server to read/write some device registers. The server maps each request to suitable device read/write request packets and carries out the necessary transaction with the device. Then it relays the result back to the client after processing and, if necessary, casts the collected device data to the proper format. Apart from reporting contents of normal device registers, the server can also collect special data like waveform capture/recording data from the device and pass it to a client.

In general, the DDE server 54 uses the Modbus RTU protocol to communicate with a field device. The DDE server 54 provides appropriate return values as specified for all clients, i.e., periodic polling packets for active topics and items, periodic polling packets for events and status, periodic update of time to all the devices, data value update to clients for acquired items, event/status report to InTouch so that it becomes part of normal alarm log, and status update for active devices (topics). Set point write requests are properly formatted set point download communication packets for the request. Execution and termination of the server are initiated on user request from the DDE server window menu.

The Tagging Wizard closely couples the one-line diagrams, tabular data and large faceplates of a device 11 in the PMCS 10 with a common memory location or memory discrete tag. The Tagging Wizard provides the "Tag Menu" window that interfaces with the discrete tag to install or clear a tag symbol from the display of the corresponding device. The "Tag Menu" window uses indirect InTouch indirect tag names to achieve a generic Tag-In/Tag-out interface across several devices.

Figure 12:
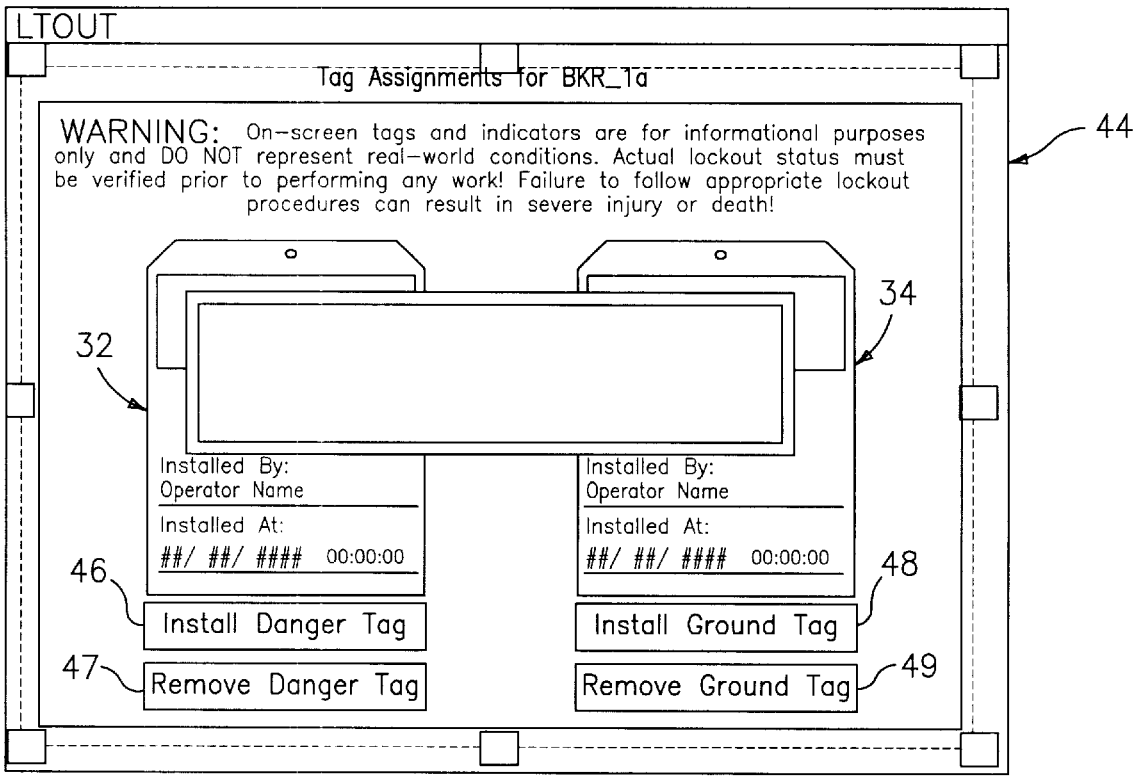
FIG. 12 is a view of a virtual lockout/tagout panel display window generated by computer software embodying the present invention at development time.

Tag using the InTouch Module for each device 11 having an associated virtual Danger and/or Ground Tag 32, 34. For example, as shown in FIG. 12, a virtual Danger and Ground Tag display 44 is assigned to the memory discrete tag having the tag name "BKR_1*a*". This common memory location is accessible by a plurality of device wizards, thereby providing an interface across several wizards. In the case of each of these wizards, the configuration dialog includes an input window that allows the user to specify a common discrete tag name. This common tag name will be used in the creation of the memory discrete tag that is set, reset or monitored by each wizard depending on the function to be performed. For example, each power wizard (i.e., large faceplate and tabular data wizards) configuring a common device 13 in the electrical distribution system 12 is configured to monitor the same memory discrete tag (i.e.,"BKR_1*a*"). These power wizards include the ALPS/LPS, DFP100, DFP200 and SR750/760.

In the operation of the Tagging Wizard, a privileged user selects a device of the electrical distribution system to remove or delete a virtual Danger and/or Ground Tag 32, 34. To install either virtual Tag, a user selects one of the buttons 46–49 for the desired virtual Tag as shown in FIG. 3. If the user installs a virtual Tag, the corresponding memory discrete tag is set. A oneline wizard monitors the same memory discrete tag associated with the "Tag Menu" window and displays the corresponding large bit map of the virtual Tags with the information concerning the installation of the Tags, as described hereinbefore. Similarly, a one line wizard for each of the tabular data and large faceplate wizards associated with the same device of the electrical distribution system also monitors this common memory discrete tag and displays the corresponding tag symbol for the graphical representation of the device 11, as shown in FIG. 2.

If the user removes a virtual Tag 32, 34, the corresponding memory discrete tag is reset or cleared. The oneline wizard removes the corresponding large bit map of the virtual Tags, as described hereinbefore. Similarly, the one line wizards for each of the tabular data and large faceplate wizards associated with the same device 11 of the electrical distribution system also monitor this common memory discrete tag and clear the corresponding tag symbol 36, 38 from the graphical representation of the device.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A method of generating a lockout tag display indicative of tagging status of a device of a power management control system; said method comprising:

selecting a device of the power management control system from a window;

selecting a tagging wizard associated with the selected device;

linking said tagging wizard to a memory register by a one-line wizard; and installing graphically a lockout tag associated with the device.

2. The method of claim 1 wherein said tagging wizard providing a navigational link between said tagging wizard and another wizard displaying a graphical representation of the device.

3. The method of claim 2 wherein the navigational link includes said memory register commonly addressable by said tagging wizard and said another wizard.

4. The method of claim 1 wherein installing said lockout tag comprising generating a graphical representation of said lockout tag.

5. The method of claim 4 wherein said lockout tag includes information of the individual installing said lockout tag.

6. The method of claim 4 wherein said lockout tag includes information of the time of the installation of the lockout tag.

7. The method of claim 1 wherein installing said lockout tag comprises generating a graphical symbol adjacent a graphical representation of the device of another wizard.

8. The method of claim 2 wherein the another wizard is a faceplate power wizard.

9. The method of claim 2 wherein the another wizard is a tabular data power wizard.

10. The method of claim 1 further comprising removing a lockout tag associated with the device.

11. The method of claim 1 wherein said lockout tag is a ground tag indicative of the tagged device having a grounded lead.

12. The method of claim 1 wherein said lockout tag is a danger tag indicative of a dangerous condition if the tagged device is actuated.

13. The method of claim 1 further comprising providing an access level for the tagging wizard, wherein access to install the lockout tag by a user is permitted, provided the user has an assigned access level at least equal to the access level of the tagging wizard.

14. The method of claim 1 wherein installing said lockout tag includes setting a bit at said memory register.

15. The method of claim 10 wherein removing said lockout tag includes clearing a bit at said memory register.

* * * * *